US007753730B2

(12) United States Patent
Furio et al.

(10) Patent No.: US 7,753,730 B2
(45) Date of Patent: Jul. 13, 2010

(54) ELECTRICAL CONTACT HOLDER ASSEMBLY

(75) Inventors: Miguel Furio, Chaville (FR); Jeremy Dreux, Courdimanche (FR)

(73) Assignee: Tyco Electronics France SAS, Pontoise (FR)

( * ) Notice: Subject to any disclaimer, the term of this patent is extended or adjusted under 35 U.S.C. 154(b) by 301 days.

(21) Appl. No.: 12/047,510

(22) Filed: Mar. 13, 2008

(65) Prior Publication Data

US 2008/0248677 A1 Oct. 9, 2008

(30) Foreign Application Priority Data

Apr. 5, 2007 (FR) ..... 07 54319

(51) Int. Cl.
*H01R 13/648* (2006.01)

(52) U.S. Cl. ..... 439/607.08; 439/607.05; 439/607.34; 439/95

(58) Field of Classification Search ..... 439/607.08, 439/607.05, 607.15, 607.41, 607.34, 607.23, 439/108, 95

See application file for complete search history.

(56) References Cited

U.S. PATENT DOCUMENTS 5,190,473 A 3/1993 Mroczkowski et al.
5,725,387 A * 3/1998 O'Sullivan et al. ..... 439/98
6,210,230 B1 4/2001 Lai
6,428,344 B1 * 8/2002 Reed ..... 439/455
6,468,110 B2 * 10/2002 Fujino et al. ..... 439/607.41
6,471,547 B1 * 10/2002 Venaleck et al. ..... 439/607.06
6,817,898 B2 * 11/2004 Tanaka et al. ..... 439/579
7,147,512 B2 * 12/2006 Wu ..... 439/607.05
2001/0031579 A1 10/2001 Fujino et al.
2004/0115988 A1 6/2004 Wu

FOREIGN PATENT DOCUMENTS

EP 1 303 011 A1 4/2003
GB 2 261 328 5/1993

* cited by examiner

*Primary Examiner*—Xuong M Chung-Trans
(74) *Attorney, Agent, or Firm*—Barley Snyder LLC

(57) ABSTRACT

An electrical contact assembly holder includes a body having a cable interface. A contact holder is attached to the body on a side opposite from the cable interface and is provided with a plurality of contacts arranged in rows. Each of the contacts has a base that secures the contact to the contact holder. At least one electrically conductive plate is disposed inside the body and extends substantially parallel to the contacts from the cable interface to the base of the contacts. The electrically conductive plate is electrically connected to the contacts and has recesses that receive the contacts to separate the rows of the contacts. A resilient tab extends from the electrically conductive plate to an outside of the electrical contact assembly holder. The resilient tab is electrically conductive and is configured to engage a shielding shell of a connector that receives the electrical contact assembly holder.

12 Claims, 4 Drawing Sheets

ELECTRICAL CONTACT HOLDER ASSEMBLY

CROSS-REFERENCE TO RELATED APPLICATIONS

This application claims the benefit of the filing date under 35 U.S.C. §119(a)-(d) of French Patent Application No. 0754319, filed Apr. 5, 2007.

FIELD OF THE INVENTION

The present invention generally relates to an electrical contact holder assembly provided with an electrically conductive plate that shields individual wires of one or more cables that electrically connected to contacts in the electrical contact holder assembly.

BACKGROUND

In certain electrical connection applications it is necessary to assemble a plurality of cables into a single electrical contact holder assembly mounted in a connector in order to easily connect the latter to an electrical device, for example another connector or electrical unit each provided with a corresponding electrical contact holder assembly. Each individual wire entering the electrical contact holder assembly from a cable is thus connected to at least one contact, which is either a male pin type contact or a female socket type contact that will be subsequently connected to a complimentary male pin type contact or female socket type contact provided on the electrical contact holder assembly of the electrical device to be connected. In some cases one or more of the cables are shielded. Therefore, on the one hand, the problem is one of retaining within the electrical contact holder assembly and the associated connector the impedance as close as possible to the impedance observed in the cables and, on the other hand, ensuring the continuity of the individual shielding of each of the individual wires of the cables inside the electrical contact holder assembly up to the electrical device to which the connector is designed to be connected.

A known solution to this problem consists in substantially conserving the geometry of the cable and the dielectric properties of the materials constituting the cable within the electrical contact holder assembly, and in particular for insulations. As cables generally have an essentially circular cross-section this approach has led to the development of essentially cylindrical electrical contact holder assemblies, which substantially retain the geometry of the cable, as well as the dielectric properties of the materials constituting the cable, with an external shielded shell.

However, in certain aeronautical and military applications the imposed thermal and mechanical constraints limit the choice of materials to those materials having performances which are unsuitable in relation to the performances of the materials used for the cables, notably with regard to the dielectric constants. Two solutions have been proposed to overcome this problem: a reduction in the section of the contacts in the electrical contact holder assembly and an increase in the distance between the contacts in order to limit the differences in the impedance between the cable and the electrical contact holder assembly.

However, reducing the section of the contacts weakens the contacts and makes the contacts more difficult to install and often prevents them from being disassembled. Further, it is preferable to use standardized contacts as it reduces costs, greatly facilitates cabling, and ensures good durability. Additionally, increasing the distance between the contacts disadvantages the useful section inside the electrical contact holder assemblies, as a larger electrical contact holder assembly section is required to dispose the same number of contacts. Designers are therefore faced with three major and problematic constraints: the choice of materials and their properties (notably mechanical, electrical and thermal); the diameter of the contacts to be used; and the spacing between the contacts.

In addition, electrical contact holder assemblies, in particular for aeronautical and military applications, are increasingly subject to detailed standardizations, which define their interface and their geometry, allowing complete and secure interchangeability with electrical contact holder assemblies from various manufacturers. Therefore, a certain number of these standardized electrical contact holder assemblies present a reduced section with a well defined geometry and in particular a rectangular cross-section with rows of contacts which are either male pin type contacts or female socket type contacts, depending on if it is a male or female electrical contact holder assembly.

The solutions proposed for cylindrical electrical contact holder assemblies are therefore not applicable to these electrical contact holder assemblies, since in the case of an increase in the distance between the contacts it is not possible to retain a sufficient number of contacts in the electrical contact holder assembly to ensure the connection of several cables, and, in the case of a reduction in the section of the contacts the restrictions imposed by the standards, notably the aeronautical and military standards in terms of mechanical resistance, will no longer be followed.

Furthermore, it is impossible for designers to selectively dispose contacts in a geometrically shaped section and for a given size to avoid coupling problems. Moreover, the external shielding of an electrical contact holder assembly using an existing accessory does not allow the selective shielding of certain contacts inside the same electrical contact holder assembly. A shielding element which is added to the outside of a electrical contact holder assembly will interfere with the areas of the electrical contact holder assembly designed for locking, coding and sealing which are otherwise often standardized.

SUMMARY

The invention relates to an electrical contact assembly holder comprising a body having a cable interface. A contact holder is attached to the body on a side opposite from the cable interface and is provided with a plurality of contacts arranged in rows. Each of the contacts has a base that secures the contact to the contact holder. At least one electrically conductive plate is disposed inside the body and extends substantially parallel to the contacts from the cable interface to the base of the contacts. The electrically conductive plate is electrically connected to the contacts and has recesses that receive the contacts to separate the rows of the contacts. A resilient tab extends from the electrically conductive plate to an outside of the electrical contact assembly holder. The resilient tab is electrically conductive and is configured to engage a shielding shell of a connector that receives the electrical contact assembly holder.

DETAILED DESCRIPTION OF THE EMBODIMENT(S)

Figure 1:
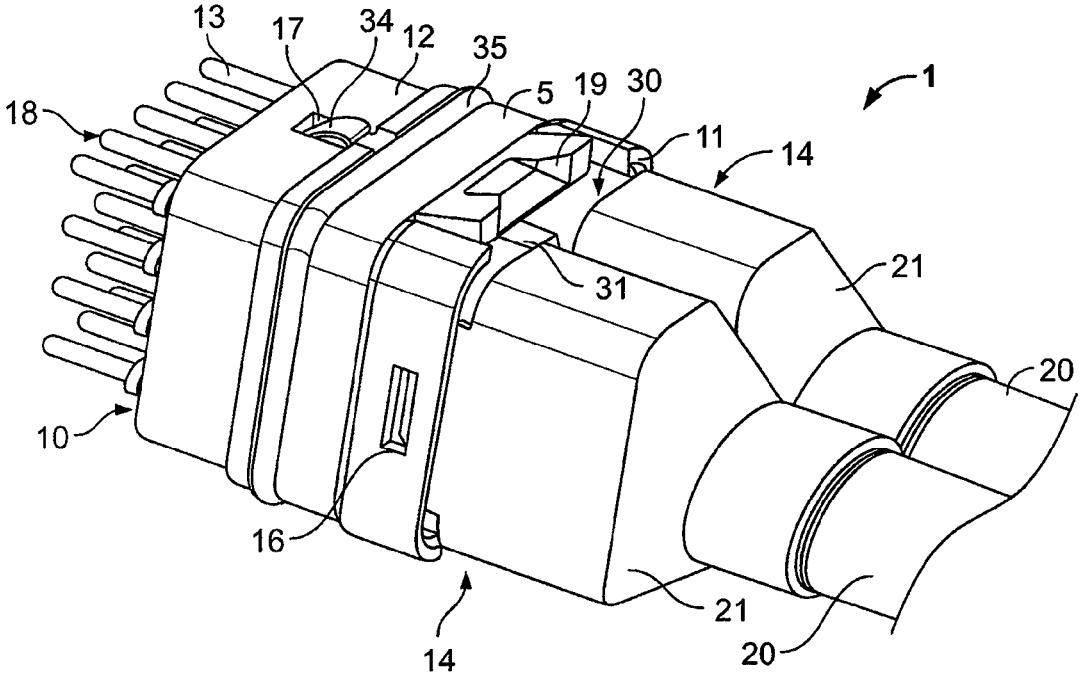
FIG. 1 is a perspective view of an electrical contact holder assembly according to a first embodiment of the invention.
Figure 2:
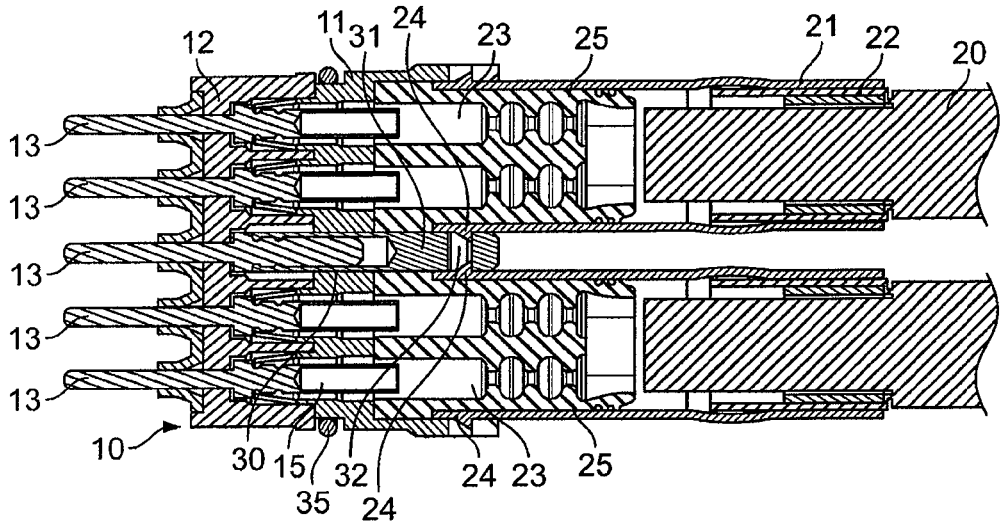
FIG. 2 is a cross sectional view of the electrical contact holder assembly of FIG. 1.
Figure 3:
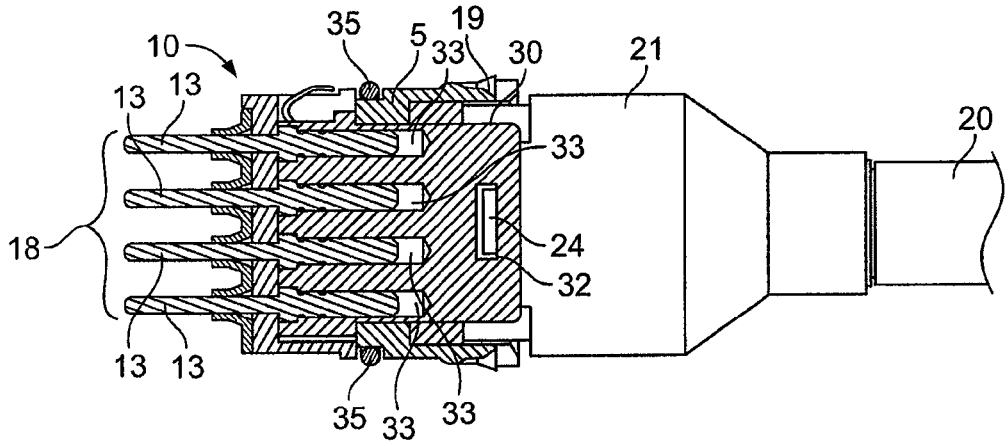
FIG. 3 is a partial sectional view of the electrical contact holder assembly of FIG. 1.

FIGS. 1-3 show an electrical contact holder assembly 1 according to a first embodiment of the present invention. The electrical contact holder assembly 1 has a substantially rectangular cross-section and includes a body 5 and a contact holder 12. As shown in FIG. 1, the contact holder 12 has a coupling interface 10. An opening 17 is provided in the contact holder near the coupling interface 10. The contact holder 12 is provided with a plurality of contacts 13 configured to be connected to an electrical device (not shown), such as another electrical contact holder assembly or an electrical unit. For example, in the illustrated embodiment, the contacts 13 are male pin type contacts, which are designed to be connected to sockets (not shown) on the electrical device (not shown) to be connected. The contacts 13 extend from the coupling interface 10 and are evenly distributed in rows 18. A hollow contact portion 15 of each of the contacts is arranged in the contact holder 12.

As shown in FIG. 1, the body 5 has a cable interface 11. The body 5 has a seal 35 extending about an outer portion thereof. The cable interface 11 has slots 16 provided on either side thereof. Anchoring hooks 19 are provided on the body 5 near the cable interface 11. The cable interface 11 is configured to receive cable receiving members 14. Each of the cable receiving members 14 are made from a metal material and have an end portion 21. Each of the end portions 21 has a latching member 24 in the form of a substantially triangular projection disposed on either side thereof, as shown in FIG. 2. The latching members 24 have a shape corresponding to the slots 16 on the cable interface 11 of the body 5 and co-operate therewith in order to mechanically retain the end portions 21 on the cable interface 11.

Each of the end portions 21 is configured to receive a cable 20. The cables 20 may be, for example, identical Ethernet-type cables for high-speed connections. To attach the cables 20 to the end portions 21, the end portions 21 may be fitted over the cables 20 and crimped thereto. As shown in FIG. 2, each of the cables 20 has a peripheral shielding layer which is directly connected to the end portion 21 at a junction between the cable 20 and the end portion 21. A metal ring 22 is inserted between the cable shielding and the end portion 21 to improve crimping of the end portion 21 on the cable 20. The metal ring 22 serves to absorb crushing forces and ensures improved electrical contact. It will be appreciated by those skilled in the art that although only two of the cables 20 are shown in the illustrated embodiment, that any number of the cables 20 may be connected to the electrical contact holder assembly 1 depending on the desired properties thereof.

As shown in FIG. 2, sockets 23 are provided for the passage of individual wires (not shown) from the cable 20 to the contacts 13. Each of the sockets 23 opens onto one of the hollow contact portions 15 of the contacts 13. The hollow contact portions 15 are crimped to the individual wires (not shown) to connect the cables 20 to the contacts 13. A seal element 25 is provided between the cable interface 11 and each of the end portions 21. The seal element 25 substantially surrounds the sockets 23.

As shown in FIGS. 1 and 3, an electrically conductive plate 31 is installed in a recess 30 that extends from the body 5 of the cable interface 11 to the contact holder 12. The electrically conductive plate 31 extends substantially parallel to the contacts 13 and is dimensioned and positioned in the body 5 of the electrical contact holder assembly 1 such that the electrically conductive plate 31 extends from the cable interface 11 to a base of the contacts 13 installed in the contact holder 12 and contacts the base. As shown in FIG. 3, the electrically conductive plate 31 has recesses 33 designed to receive the rows 18 of the contacts 13. Additionally, the electrically conductive plate 31 is substantially the same height as the body 5, so that the base of each of the contacts 13 located on either side of the electrically conductive plate 31 can be separated, as shown in FIG. 2.

As shown in FIG. 3, the electrically conductive plate 31 has traversing slots 32 configured to co-operate with the latching members 24 on the end portions 21 of the cable receiving members 14. The slots 32 thereby lock the electrically conductive plate 31 to the cable receiving members 14. Because the end portions 21 of the cable receiving members 14 are made from a metal material and the latching members 24 contact the slots 32 of the electrically conductive plate 31, electrical contact there between is ensured so that continuity in the shielding between the end portion 21 and the electrically conductive plate 31 is also ensured.

As shown in FIG. 1, the electrically conductive plate 31 has a resilient tab 34 integrally formed with the electrically conductive plate 31 and disposed in an extension of the electrically conductive plate 31 near the contact holder portion 12. Alternatively, the resilient tab 34 may be mechanically connected to the electrically conductive plate 31 using any known mounting method, for example, soldering. The resilient tab 34 is configured to be received in the opening 17 in the contact holder 12 and extend there from such that the resilient tab 34 contacts a shielding shell 42 (FIG. 6) of a connector 40 (FIG. 6) designed to receive the electrical contact holder assembly 1. In this way, when the electrical contact holder assembly 1 is inserted into the connector 40, there is continuity of shielding between the electrically conductive plate 31 and the shielding shell 42 (FIG. 6) in a particularly simple, reliable and effective manner. The connector 40 (FIG. 6) is therefore advantageously used to act as shielding around the electrical contact holder assembly 1.

In the electrical connector assembly 1, electrical continuity of the shielding is ensured with the electrical device (not shown) to be connected, as well as respective continuity of the shielding between the contacts 13 located on either side of the row 18 of the contacts 13. The electrically conductive plate 31 is electrically connected to the shielding of at least one of the cables 20 via the end portion 21. Thus, the respective shielding of the groups of the contacts 13 located on either side of the electrically conductive plate 31 is ensured inside the body 5 of the electrical contact holder assembly 1. Therefore, the present invention advantageously allows selective shielding of certain of the contacts 13 to be assured inside the same electrical contact holder assembly 1. Additionally, the contacts 13 used in the electrical contact holder assembly 1 are standard which reduces the cost of the electrical contact holder assembly 1 while guaranteeing optional durability and the use of known implementation tools and procedures.

Figure 4:
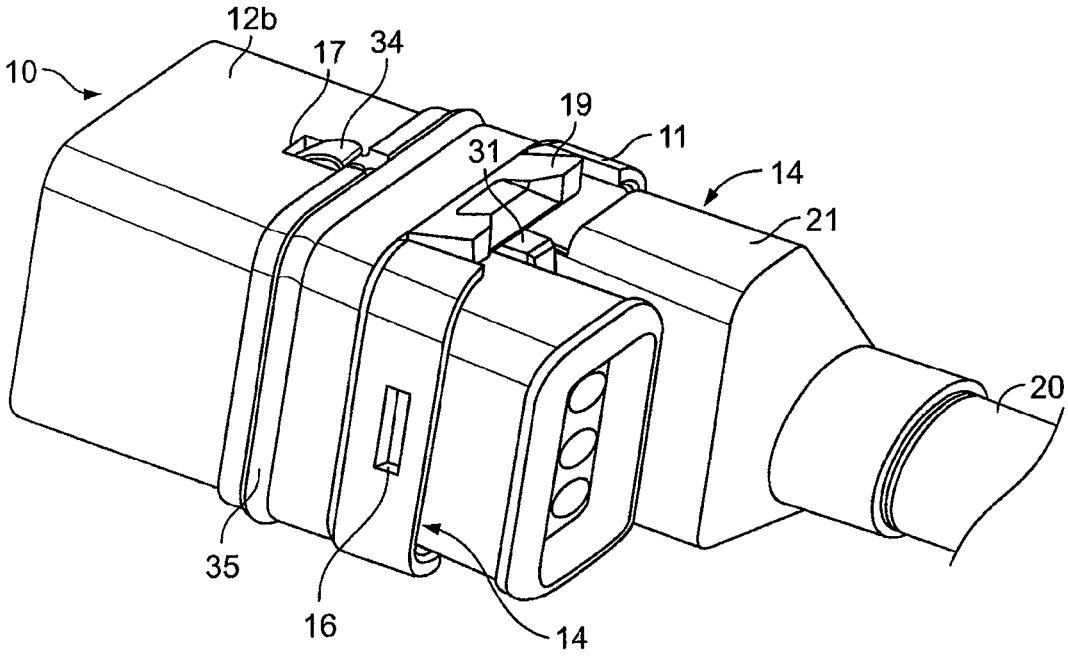
FIG. 4 is a perspective view of an electrical contact holder assembly according to a second embodiment of the invention.
Figure 5:
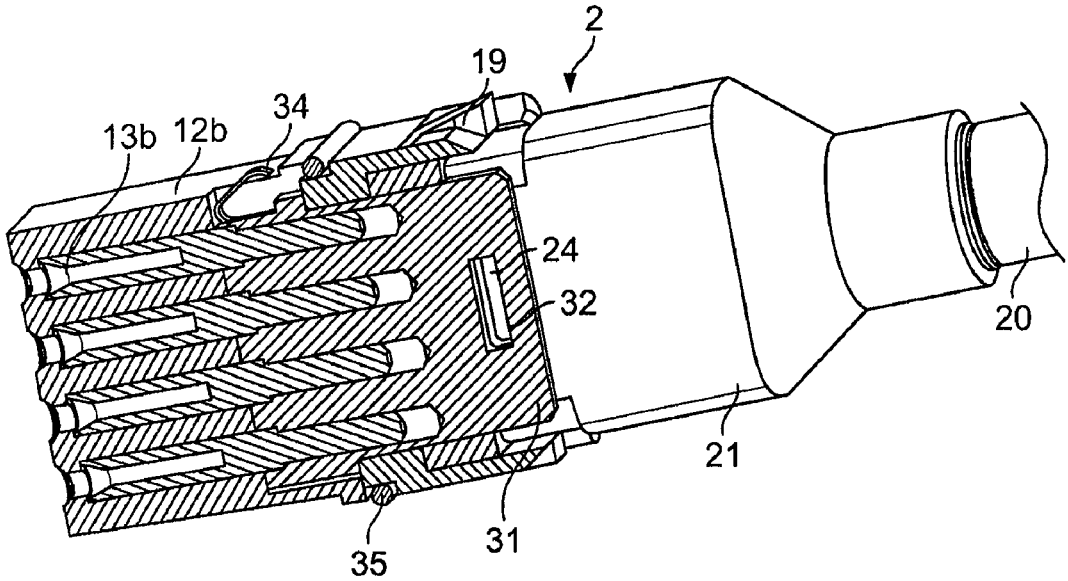
FIG. 5 is a partial sectional perspective view of the electrical contact holder assembly of FIG. 4.

FIGS. 4-5 show an electrical contact holder assembly 2 according to a second embodiment of the present invention. Basically, the electrical contact holder assembly 2 is identical to the electrical contact holder assembly 1 shown in FIGS. 1-3 except that the electrical contact holder assembly 2 is the female version of the electrical contact holder assembly 1 shown in FIGS. 1-3. Because the electrical contact holder assembly 2 is substantially identical to the electrical contact holder assembly 1 shown in FIGS. 1-3, only the differences there between will be described in further detail herein.

As shown in FIG. 5, the electrical contact holder assembly 2 has a connection portion 12*b* provided with a plurality of contacts 13*b*. The contacts 13*b* are female socket type contacts. Because the bases of the contacts 13*b* are of a standard form, the contacts 13*b* may easily be installed in the recesses 33 of the electrically conductive plate 31. As is the case in the electrical contact holder assembly 1 shown in FIGS. 1-3, the contacts 13*b* are standard which reduces the cost of the electrical contact holder assembly 2, particularly in designing the recesses 33 for the installation of the contacts 13*b*. In other words, the recesses 33 can accommodate the male pin type contacts or the female socket type contacts.

Figure 6:
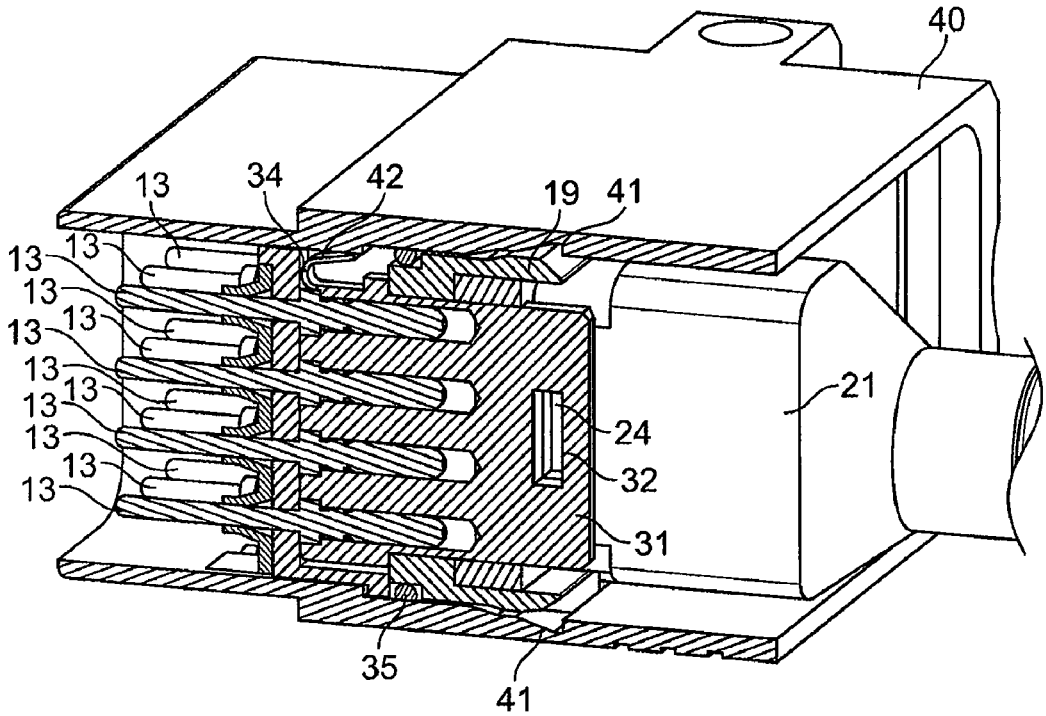
FIG. 6 is a partial sectional perspective view of the electrical contact holder assembly according to FIG. 1 shown mounted in a connector.

FIG. 6 shows the electrical contact holder assembly 1 shown in FIGS. 1-3 mounted in the connector 40, which has a body made from a metal material. When the electrical contact holder assembly 1 is inserted into the connector 4, the anchoring hooks 19 engage with a recess 41 inside the connector 40 to ensure mechanical retention of the electrical contact holder assembly 1 in the connector 40. The resilient tab 34 bears against the shielding shell 42 of the connector 40, which in this example is a wall of the body of the connector, to ensure electrical continuity of the shielding in a particularly reliable and simple manner. Thus, the shielding is divided between a section integral to the connector 40 and a section belonging to the electrical contact holder assembly 1. Therefore, this existing shielding element, which is the connector 40, is electrically connected to the electrical contact holder assembly 1 when the electrical contact holder assembly 1 is installed in the connector 40. Additionally, the seal 35 provided between the connector 40 and the body 5 of the electrical contact holder assembly 1 protects the contacts 13 against humidity.

Figure 7:
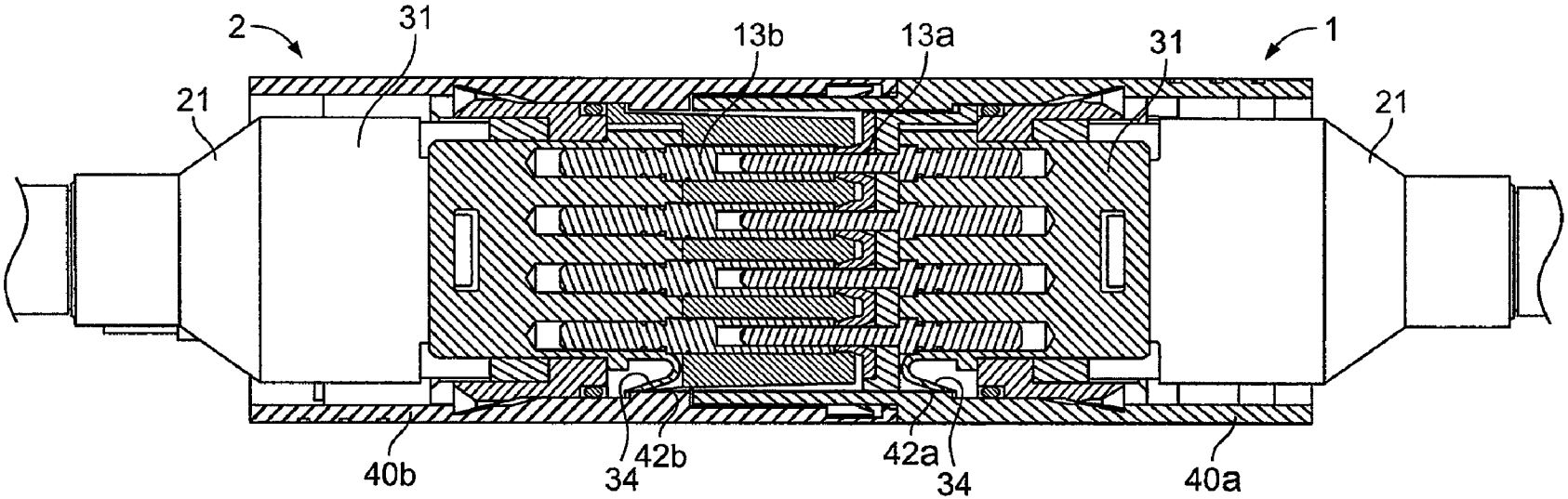
FIG. 7 is a partial sectional view of the electrical contact holder assembly according to FIG. 1 mated with the electrical contact holder assembly according to FIG. 4.

FIG. 7 shows the electrical contact holder assembly 1 shown in FIGS. 1-3 and the electrical contact holder assembly 2 shown in FIGS. 4-5 mounted in connectors 40*a*, 40*b*, respectively, and mated with each other. FIG. 7 shows the particularly simple and reliable continuity of shielding between the end portions 21, the electrically conductive plates 31, the contacts 13*a*, 13*b* which are respectively installed therein, and the connectors 40*a*, 40*b* via the tabs 34 and the shielding shells 42*a*, 42*b*, respectively. Thus, it can be seen that the electrically conductive plates 31 in both the first and second embodiments are advantageously dimensioned to substantially retain the impedance of the cables 20 connected to the electrical contact holder assemblies 1, 2 within the respective connectors 40*a*, 40*b*.

The foregoing illustrates some of the possibilities for practicing the invention. Many other embodiments are possible within the scope and spirit of the invention. For example, the connector 40 may be connected to a specific base for assembly to a printed circuit (not shown) whereby the contacts 13 connected to the electrically conductive plate 31 are also connected to an external shielding which fully protects the electrical connections of the electrical device (not shown) containing the printed circuit (now shown). In a further embodiment, the electrical contact holder assembly 1, 2 may be connected to three parallel cables and two electrically conductive plates, which are disposed on either side of the contacts assigned to the central cable. Also, the electrical contact holder assembly 1, 2 is not limited to a substantially rectangular shaped cross-section and may be, for example, circular, polygonal, or any other geometric shape. It is, therefore, intended that the foregoing description be regarded as illustrative rather than limiting, and that the scope of the invention is given by the appended claims together with their full range of equivalents.

What is claimed is:

1. An electrical contact assembly holder, comprising:

a body having a cable interface;

a contact holder attached to the body on a side opposite from the cable interface, the contact holder being provided with a plurality of contacts arranged in rows, each of the contacts having a base that secures the contact to the contact holder;

at least one electrically conductive plate disposed inside the body and extending substantially parallel to the contacts from the cable interface to the base of the contacts, the electrically conductive plate being electrically connected to the contacts and having recesses that receive the contacts to separate the rows of the contacts; and a resilient tab extending from the electrically conductive plate to an outside of the electrical contact assembly holder, the resilient tab being electrically conductive and being configured to engage a shielding shell of a connector that receives the electrical contact assembly holder.

2. The electrical contact assembly holder of claim 1, wherein at least one cable receiving member is attached to the cable interface, the cable receiving member being a metal material.

3. The electrical contact assembly holder of claim 2, wherein the electrically conductive plate is electrically connected to the cable receiving member.

4. The electrical contact assembly holder of claim 3, wherein the cable receiving member has a latching member that attaches the cable receiving member to the cable interface and the electrically conductive plate has a slot that receives the latching member.

5. The electrical contact assembly holder of claim 2, wherein a socket extends from the cable receiving member to a contact portion of the contacts.

6. The electrical contact assembly holder of claim 5, wherein a seal element substantially surrounds the sockets.

7. The electrical contact assembly holder of claim 2, further comprising a cable attached to the cable receiving member, the cable being electrically connected to the contacts.

8. The electrical contact assembly holder of claim 1, wherein the resilient tab extends to the outside of the electrical contact assembly holder through an opening in the contact holder.

9. The electrical contact assembly holder of claim 1, wherein the base is substantially in a middle of the contact.

10. The electrical contact assembly holder of claim 1, wherein the contacts are male pin type contacts.

11. The electrical contact assembly holder of claim 1, wherein the contacts are female socket type contacts.

12. The electrical contact assembly holder of claim 1, wherein the electrically conductive plate is electrically connected to the base of the contacts.

* * * * *